US005608930A

United States Patent [19]

Chen

[11] Patent Number: 5,608,930

[45] Date of Patent: Mar. 11, 1997

[54] FOLDABLE BED

[76] Inventor: Mao-Wang Chen, No. 29, Lane 465, Lieng Tsuen Road, Fong Yuen City, Taichung Hsien, Taiwan

[21] Appl. No.: 438,528

[22] Filed: May 10, 1995

[51] Int. Cl.[6] ..... A47C 19/00; A47C 19/12

[52] U.S. Cl. ..... 5/174; 5/176.1

[58] Field of Search ..... 5/174, 175, 176.1, 5/182, 111, 114, 465

[56] References Cited

U.S. PATENT DOCUMENTS

| | | | |
|---|---|---|---|
| 1,056,317 | 3/1913 | Biro | 5/174 |
| 2,337,955 | 12/1943 | Wright | 5/111 |

FOREIGN PATENT DOCUMENTS

| | | | |
|---|---|---|---|
| 0669460 | 9/1965 | Belgium | 5/465 |
| 0537080 | 7/1923 | France | 5/174 |
| 2734460 | 2/1979 | Germany | 5/465 |
| 0028489 | 5/1903 | Switzerland | 5/175 |

*Primary Examiner*—Darnell M. Boucher
*Assistant Examiner*—Robert G. Santos
*Attorney, Agent, or Firm*—Charles E. Baxley, Esq.

[57] ABSTRACT

A foldable bed includes a pair of legs arranged between a head member and a foot member. Four pairs of pivot axels are arranged between and coupled to the members and the legs by four pairs of links. Two pairs of frames are pivotally coupled between the legs and the members and each pair include a middle portion pivotally coupled together by a hinge member so as to allow the frames to be folded upward about the hinge member and so as to support the frames in horizontal position by the hinge member. The bed may be folded to a rather compact configuration.

1 Claim, 2 Drawing Sheets

FOLDABLE BED

BACKGROUND OF THE INVENTION

1. Field of the Invention

The present invention relates to a bed, and more particularly to a foldable bed.

2. Description of the Prior Art

Typical beds comprise a base portion and a board member secured on top of the base portion. The base portion includes a solid configuration that may not be folded.

The present invention has arisen to mitigate and/or obviate the afore-described disadvantages of the conventional beds.

SUMMARY OF THE INVENTION

The primary objective of the present invention is to provide a bed which may be folded to a rather compact configuration and which may be easily developed.

In accordance with one aspect of the invention, there is provided a foldable bed comprising a head member, a foot member, a pair of leg means arranged between the head member and the foot member, a plurality of pivot shafts secured to the head member, the foot member and the leg means, four pivot means arranged between the head member, the foot member and the leg means, four pairs of link means pivotally coupling the pivot shafts to the pivot means, and two pairs of frames pivotally coupled between the leg means and the head member and the foot member, each pair of the frames including a middle portion pivotally coupled together by hinge means so as to allow the frames to be folded upward about the hinge means and so as to support the frames in horizontal position by the hinge means.

Four cushions are further secured on top of the frames. The cushion located close to the head member includes a bulge formed thereon so as to form a pillow.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
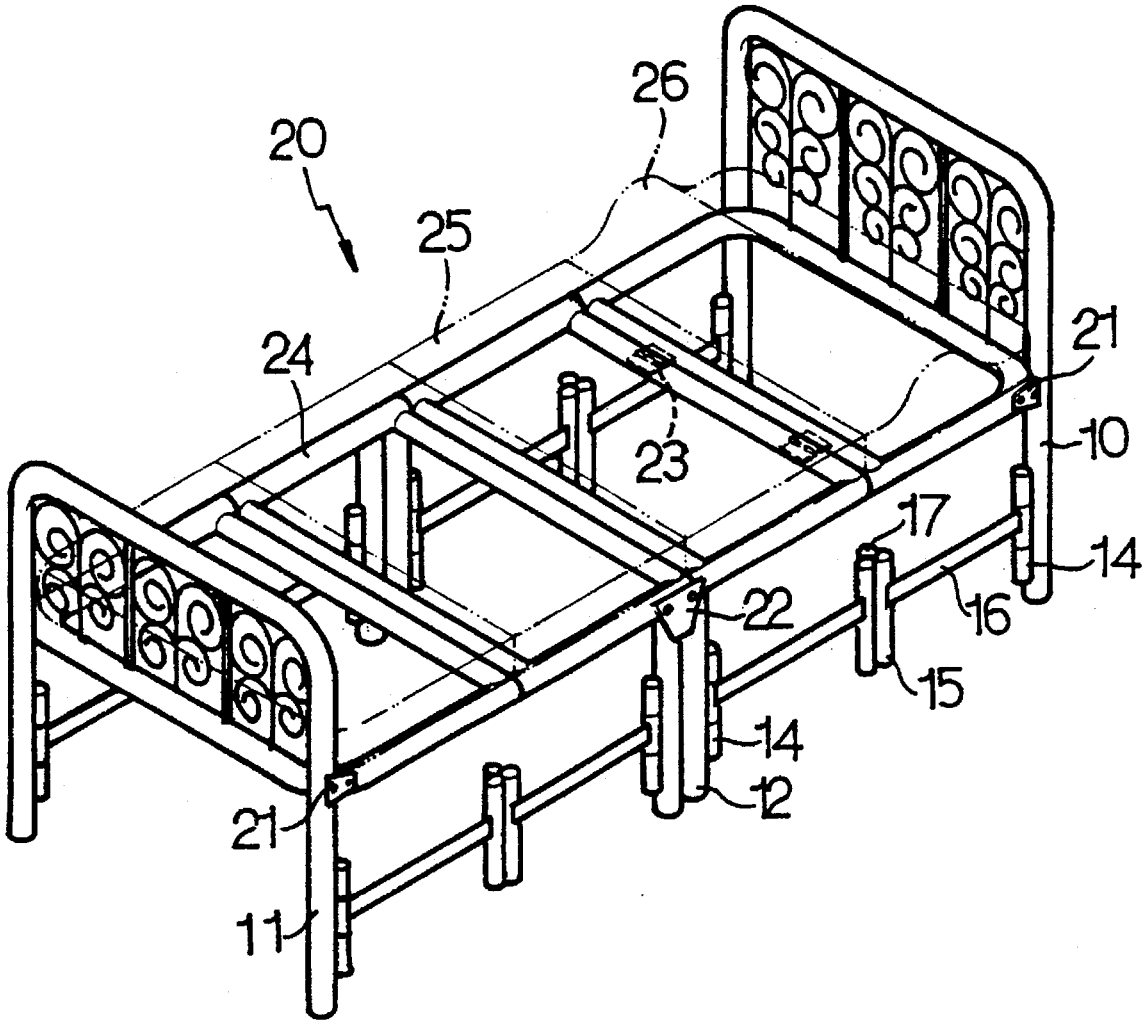
FIG. 1 is a perspective view of a foldable bed in accordance with the present invention.
Figure 2:
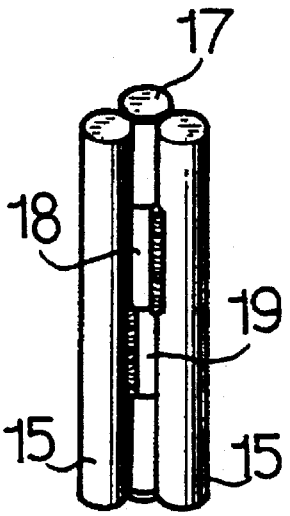
FIG. 2 is a partial perspective view illustrating the pivot connection of the foldable bed.

Referring to the drawings, and initially to FIGS. 1 and 2, a foldable bed in accordance with the present invention comprises a head member 10, a foot member 11, a pair of leg means 12, and a number of pivot shafts 14 secured to the head member 10, foot member 11 and the leg means 12. Four pivot means each includes a pair of pivot axels 15 and a pivot pin 17 having two sections 18, 19 secured to the pivot axels 15 respectively such that the pivot axels 15 are rotatable relative to each other. Four pairs of links 16 are coupled between the pivot shafts 14 and the pivot axels 15.

A support means 20 includes two pairs of frames 24 pivotally coupled to the members 10, 11 and the leg means 12 by lugs 21 and panels 22. Each pair of the frames 24 have a middle portion pivotally coupled together by hinge means 23. Four cushions or boards 25 are secured on top of the frames 24. The cushion 25 located closest to the head member 10 includes a bulge 26 formed thereon so as to form a pillow.

Figure 3:
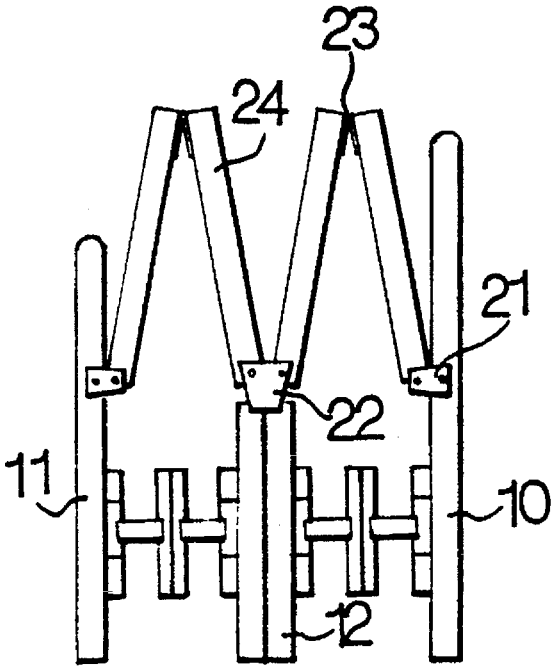
FIG. 3 is a side view illustrating the operation of the foldable bed.
Figure 4:
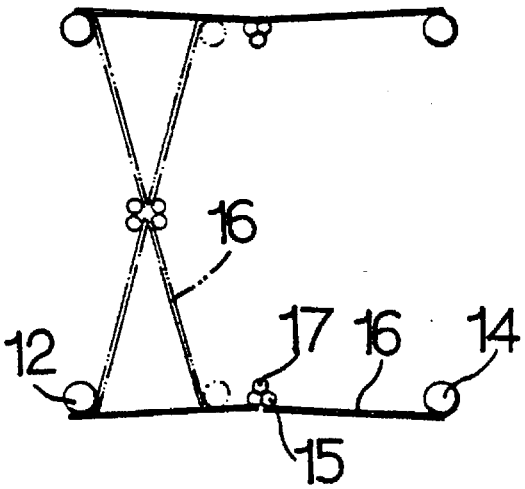
FIG. 4 is a bottom schematic view illustrating the folding operation of the base portion.

Referring next to FIGS. 3 and 4, each pair of the two pairs of frames 24 may be folded upward relative to each other about the hinge means 23, best shown in FIG. 3 and may be supported in a horizontal position as shown in FIG. 1 by the hinge means 23. Simultaneously, the links 16 may be rotated about the pivot shafts 14 and the pivot axels 15 to a folded position as shown in dotted lines in FIG. 4, such that the bed may be folded to a rather compact configuration which is excellent for storing and for transportation purposes.

Accordingly, the foldable bed in accordance with the present invention includes a configuration that may be folded to a rather compact configuration which is excellent for storing and for transportation purposes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A foldable bed comprising:

a head member, a foot member, a pair of legs arranged between said head member and said foot member, a plurality of pivot shafts secured to said head member and said foot member and said legs, four pivot axels arranged between said head member and said foot member and said legs, four pairs of links pivotally coupling said pivot shafts to said pivot axels, a first pair of frames pivotally coupled between said legs and said head member, a second pair of frames pivotally coupled between said legs and said foot member, said first pair and said second pair of said frames each including a middle portion pivotally coupled together by hinge means so as to allow said frames to be moved to a folded position upward about said hinge means and so as to support said first pair and said second pair of frames in horizontal position by said hinge means, when the frames are in said horizontal position the frames spaceable from a floor by means of the legs, there being two of the pivot shafts mounted on each legs and each of said two pivot shafts spaced inwardly from ends of its associated leg, wherein the pivot axels and the pivot shafts are always arranged in a common plane parallel and below a plane described by the frames in said horizontal position.

* * * * *